US007839100B2

(12) United States Patent
Liang et al.

(10) Patent No.: US 7,839,100 B2
(45) Date of Patent: Nov. 23, 2010

(54) FRONT-STAGE VOLTAGE-ADJUSTMENT INVERTER

(75) Inventors: Shih An Liang, Taoyuan Hsien (TW); Kuo-Hei Lee, Taoyuan Hsien (TW); Ken-Chuan Hsu, Taoyuan Hsien (TW)

(73) Assignee: FSP Technology Inc., Taoyuan Hsien (TW)

( * ) Notice: Subject to any disclaimer, the term of this patent is extended or adjusted under 35 U.S.C. 154(b) by 423 days.

(21) Appl. No.: 11/967,691

(22) Filed: Dec. 31, 2007

(65) Prior Publication Data

US 2009/0167199 A1 Jul. 2, 2009

(51) Int. Cl.
*G05F 1/00* (2006.01)

(52) U.S. Cl. ..... 315/307; 315/299; 315/308

(58) Field of Classification Search ..... 315/177, 315/200 R, 205, 209 R, 210, 219, 224, 246, 315/247, 254, 276, 287, 291, 297, 299, 300, 315/301, 302, 307, 308, 311, 313, DIG. 4; 363/13, 17, 19, 37, 59, 60, 74
See application file for complete search history.

(56) References Cited

U.S. PATENT DOCUMENTS 5,751,115 A * 5/1998 Jayaraman et al. ..... 315/225
5,914,572 A * 6/1999 Qian et al. ..... 315/307
6,995,989 B1 2/2006 Wang
2009/0045755 A1 * 2/2009 Cheng et al. ..... 315/219

FOREIGN PATENT DOCUMENTS

TW 518633 1/2003
TW I242177 B 10/2005
TW I273764 B 2/2007

* cited by examiner

*Primary Examiner*—Douglas W Owens
*Assistant Examiner*—Jianzi Chen
(74) *Attorney, Agent, or Firm*—Muncy, Geissler, Olds & Lowe, PLLC

(57) ABSTRACT

The present invention discloses a front-stage voltage-adjustment inverter, which comprises: a front-stage voltage-adjustment unit, a duty cycle modulation unit, a half-bridge driving unit and a transformer unit. The front-stage voltage-adjustment unit receives an input power, a dimming signal and a feedback signal. The front-stage voltage-adjustment unit varies the voltage of the input power according to the dimming signal and performs a feedback adjustment according to the feedback signal. In the present invention, the cycle signal generated by the duty cycle modulation unit does not vary with the dimming signal and feedback signal. Thus, the half-bridge driving unit can work in a zero-voltage switching state constantly and drive the transformer unit to output a driving power. Thereby, the present invention can decrease the switching loss and increase the service lives of loads and electronic elements.

6 Claims, 3 Drawing Sheets

FRONT-STAGE VOLTAGE-ADJUSTMENT INVERTER

FIELD OF THE INVENTION

The present invention relates to a front-stage voltage-adjustment inverter, particularly to a half-bridge inverter driving a backlight module.

BACKGROUND OF THE INVENTION

LCD (Liquid Crystal Display) has been widely used in various electronic products. In addition to the liquid crystal module, the LCD performance also correlates with the reliability of the backlight module. A backlight module comprises a set of lamps and an inverter. The inverter should provide a longtime stable current. Basically, an inverter receives a DC input and electronically converts the DC power into an AC power from the primary side of a transformer to the secondary side thereof. In other words, an inverter converts a DC power into an AC power to drive AC loads, such as CCFL (Cold Cathode Fluorescent Lamp). Inverters may be classified into the Royer type, full-bridge type, half-bridge type and pull-push type. The Royer type inverter is of self-oscillation design and hard to control lamp frequency and lamp current because of the variation of element parameters. In the push-pull type, the power transistors have to withstand double input voltage, but power transistors are more expensive and have an input-voltage limitation. Therefore, the full-bridge and half-bridge inverters are more popular. The half-bridge inverter is simpler and uses only half the power transistors used by the full-bridge inverter. Thus, using the half-bridge inverter is a cost-efficient selection. Refer to FIG. 1 for a diagram schematically showing a conventional inverter architecture used to drive a backlight module. The conventional inverter comprises: a rectifier unit 40 receiving an input power and converting the input power into a DC power, a duty-cycle modulation unit 42 coupled to the rectifier unit 40, a power factor correction unit 41, a half-bridge driving unit 43, and a transformer unit 44. The secondary side of the transformer unit 44 is further coupled to a feedback unit 45. The feedback unit 45 generates and sends a feedback signal to the duty-cycle modulation unit 42 for stabilizing the output. The power factor correction unit 41 receives the input power from the rectifier unit 40 and adjusts the phase difference between the voltage and current of the input power. The duty-cycle modulation unit 42 is coupled to a dimming signal source 3 and receives a dimming signal therefrom. The duty-cycle modulation unit 42 also receives a feedback signal from the feedback unit 45. According to the dimming signal and the feedback signal, the duty-cycle modulation unit 42 generates a duty-cycle signal to determine the duty cycle of the half-bridge driving unit 43. Thus is modulated the timing that the half-bridge driving unit 43 is turned on to allow the input power to flow toward the transformer unit 44. Then, an AC driving power is generated to drive at least one load 2. The half-bridge driving unit 43 uses the switching of power transistors to modulate the turn-on timing. To achieve zero-voltage switching and reduce the loss at two sides of the power transistors, the half-bridge driving unit 43 has to limit the duty cycle to meet the condition for zero-voltage switching. However, a conventional inverter usually has to generate a feedback signal to change the duty cycle of the half-bridge inverter so that the inverter can provide stable output to drive the load 2. Thus, the half-bridge inverter is often unable to work under the condition for zero-voltage switching, and the physical working efficiency thereof is often lower than the ideal efficiency. The prior arts disclosed in R.O.C. patents No. I273764, No. I242177, R.O.C. publication patent No. 518633 and a U.S. Pat. No. 6,995,989 are all the likes of the above-mentioned inverter. The conventional backlight module inverters usually adopt a burst mode dimming, wherein the lamps are repeatedly turned on and off. Such a method indeed attains a satisfied dimming. However, the power source providing the input power and the transformer of the inverter generate low-frequency noise because the inverter has to pulse the output thereof. The low-frequency noise will cause the discomfort of users. Further, the service lives of the lamps and electronic elements are decreased. Besides, EMI (Electro-Magnetic Interference) also become severer.

SUMMARY OF THE INVENTION

One objective of the present invention is to provide an improved half-bridge inverter to overcome the problems of the conventional half-bridge inverter and increase the efficiency and service life thereof.

The present invention is a front-stage voltage-adjustment inverter, which comprises: a rectifier unit, a power factor correction unit, a duty cycle modulation unit, a half-bridge driving unit, a transformer unit and a front-stage voltage-adjustment unit. The rectifier receives and rectifies an input power and sends the rectified power to the front-stage voltage-adjustment unit. The front-stage voltage-adjustment unit is coupled to a dimming signal source and obtains a dimming signal therefrom. The front-stage voltage-adjustment unit also obtains a feedback signal from the secondary side of the transformer unit. The front-stage voltage-adjustment unit determines a voltage-adjustment level to change the voltage of the input power according to the dimming signal and adjusts it according to the feedback signal. The duty cycle modulation unit generates a fixed duty cycle signal to control the half-bridge driving unit to work at a fixed cycle. Thus, the voltage output by the secondary side of the transformer unit can be modified to drive at least one load. The dimming signal and feedback signal control the front-stage voltage-adjustment unit to adjust the voltage of the input power beforehand to vary the output of the inverter; therefore, the half-bridge driving unit can fixedly work in a zero-voltage switching state, and the switching loss is thus reduced. Besides, the present invention doesn't need to use the low-frequency burst-mode dimming approach. Thus, the service lives of electronic elements and lamps are increased.

DETAILED DESCRIPTION OF THE PREFERRED EMBODIMENTS

Below, the technical contents of the present invention are described in detail in cooperation with the drawings.

Figure 1:
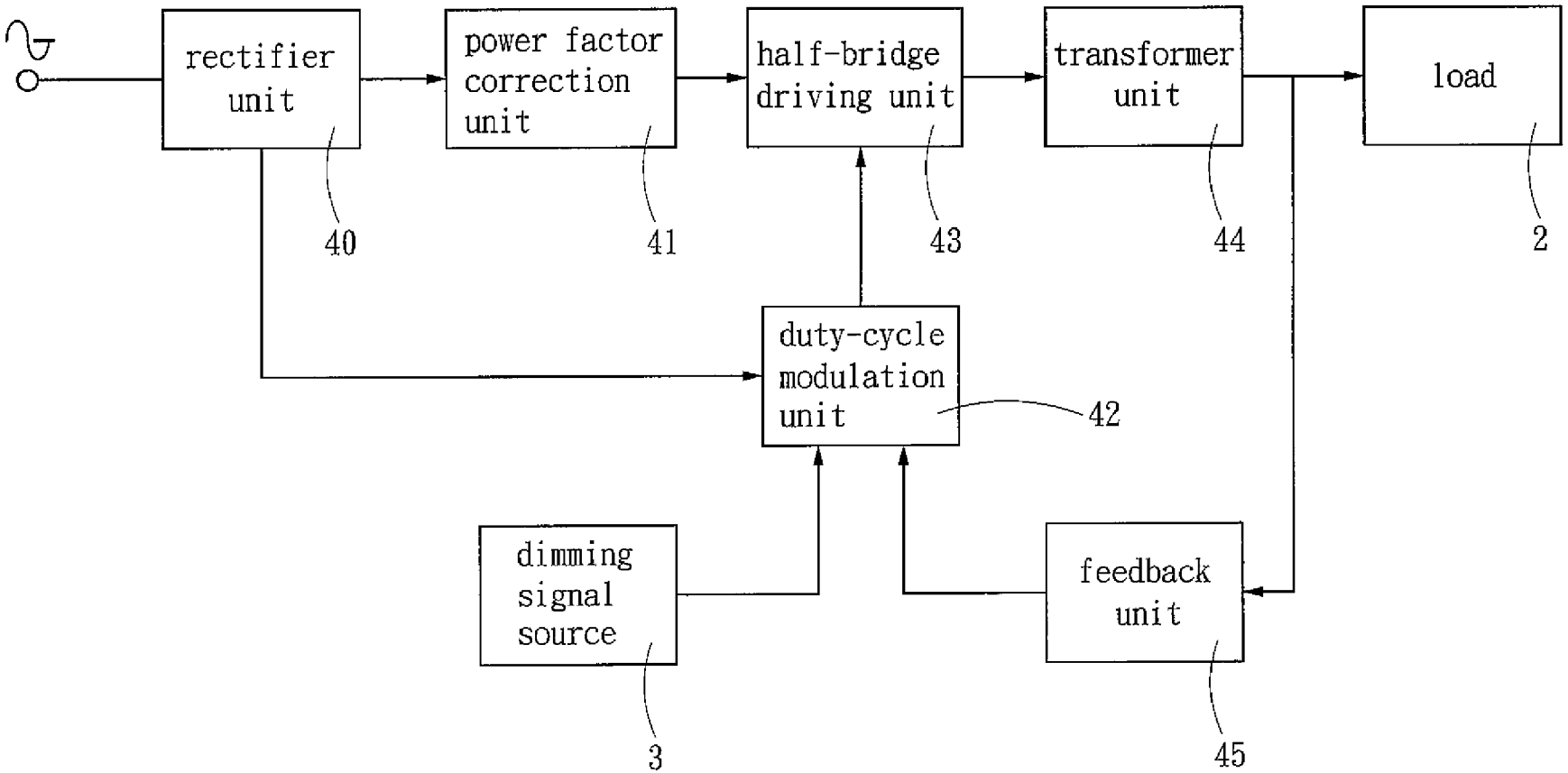
Fig. 1 PRIOR ART
FIG. 1 is a block diagram schematically showing the architecture of a conventional inverter.
Figure 2:
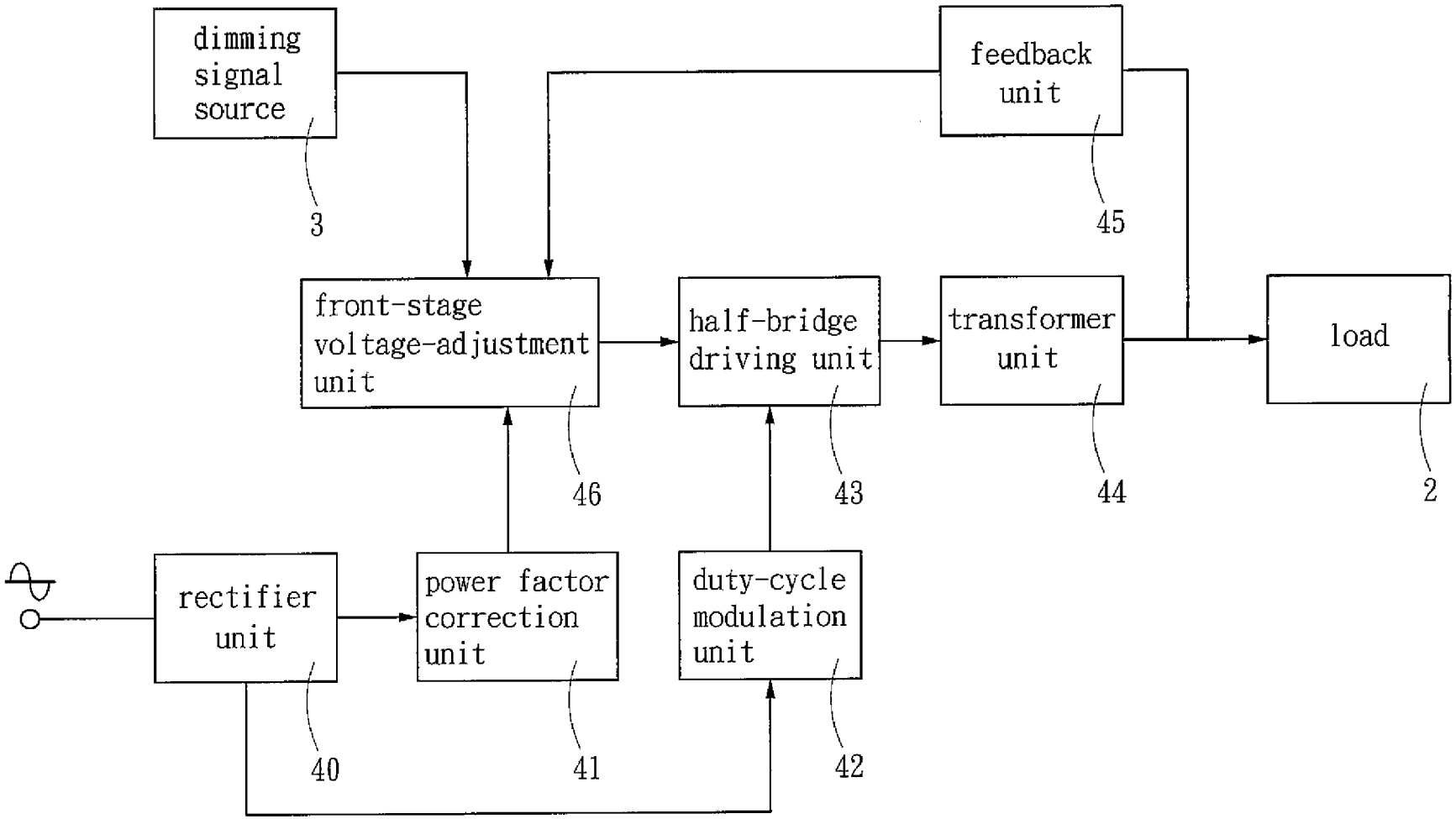
FIG. 2 is a block diagram schematically showing the architecture of a preferred embodiment according to the present invention.

Refer to FIG. 2 for a preferred embodiment according to the present invention. The present invention proposes a front-stage voltage-adjustment inverter, which receives an input power and converts the input power into a driving power to drive at least one load 2. The inverter of the present invention comprises: a rectifier unit 40, a duty cycle modulation unit 42, a half-bridge driving unit 43 and a transformer unit 44. The inverter of the present invention further comprises a front-stage voltage-adjustment unit 46 arranged in between the half-bridge driving unit 43 and the rectifier unit 40. The rectifier unit 40 converts the input power into a DC power, and the front-stage voltage-adjustment unit 46 receives the input power. A power factor correction unit 41 is arranged in between the front-stage voltage-adjustment unit 46 and the rectifier unit 40, and the power factor correction unit 41 is used to regulate the current phase of the input power. The front-stage voltage-adjustment unit 46 is coupled to a dimming signal source 3 and obtains a dimming signal therefrom. The front-stage voltage-adjustment unit 46 determines a voltage-adjustment level to change the voltage of the power transferred from the half-bridge driving unit 43 to the transformer unit 44 according to the dimming signal. The duty cycle modulation unit 42 receives the input power from the rectifier unit 40 and generates a cycle signal. The cycle signal drives the half-bridge driving unit 43 to turn on and conduct the current of the input power to flow toward the transformer unit 44. Then, the transformer unit 44 converts the input power into a driving power to drive at least one load 2. A feedback unit 45 is coupled to the secondary side of the transformer unit 44 to generate a feedback signal. According to the feedback signal, the front-stage voltage-adjustment unit 46 modifies the voltage of the input power to stabilize the voltage of the driving power. Via the abovementioned architecture of the present invention, the dimming signal and feedback signal control the front-stage voltage-adjustment unit 46 to modify the voltage of the input power and vary the value of the driving power. Thus, the cycle signal generated by the duty cycle modulation unit 42 needn't vary with the dimming signal and feedback signal. Therefore, the half-bridge driving unit 43 can maintain a fixed duty cycle and work in a zero-voltage switching state.

Figure 3:
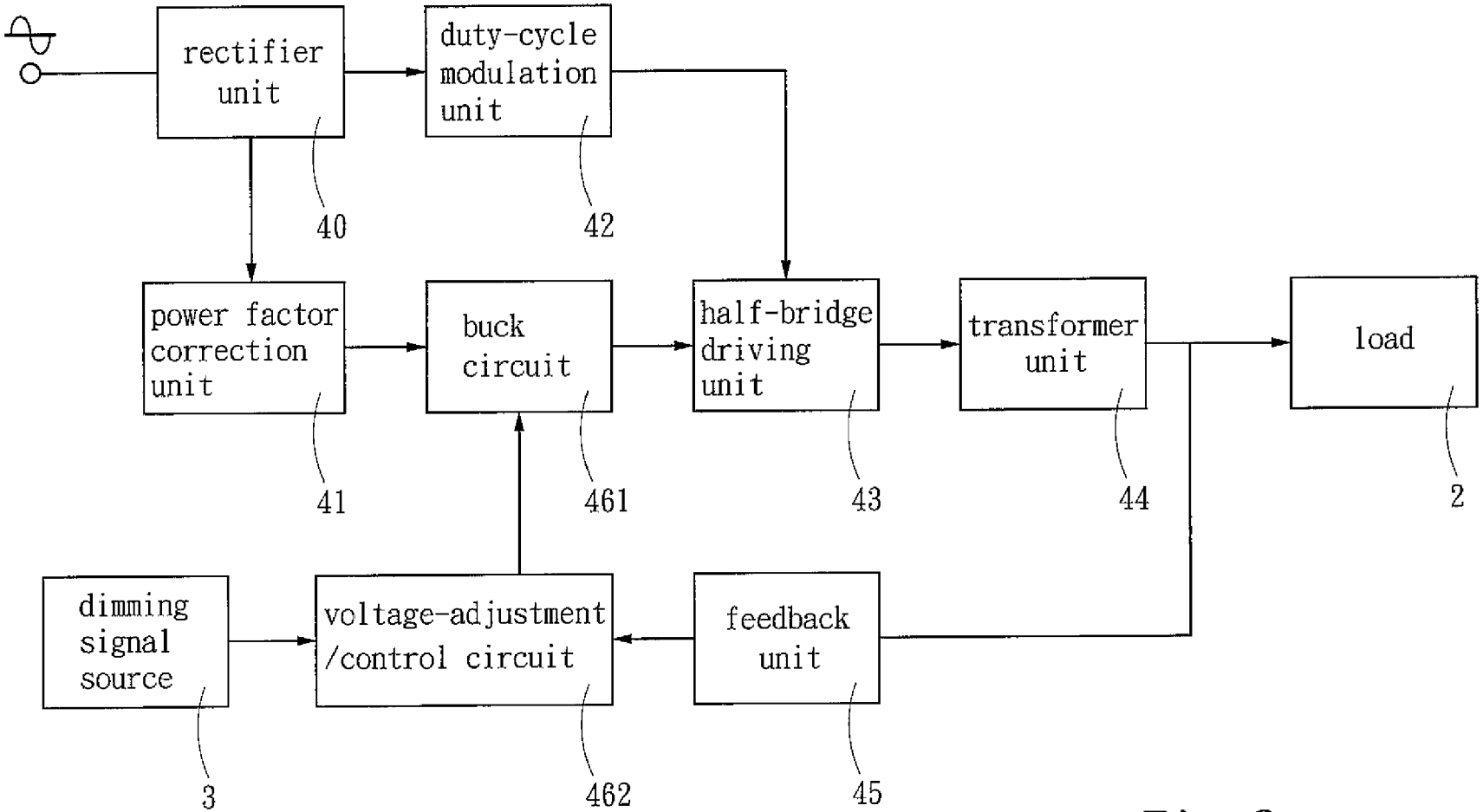
FIG. 3 is a block diagram schematically showing the architecture of a front-stage voltage-adjustment unit according to the present invention.

Refer to FIG. 3 for the architecture of the front-stage voltage-adjustment unit 46 according to the present invention. The front-stage voltage-adjustment unit 46 further comprises a buck circuit 461 and a voltage-adjustment/control circuit 462. The input power is transferred through the power factor correction unit 41 to the buck circuit 461. The voltage-adjustment/control circuit 462 is coupled to the dimming signal source 3 and the feedback unit 45. The voltage-adjustment/control circuit 462 generates a periodic switching signal to control the duty cycle, which switches the buck circuit 461, according to the dimming signal and feedback signal. The buck circuit 461 modifies the input power according to the duty cycle. The half-bridge driving unit 43 conducts the input power to the transformer unit 44 according to a fixed cycle signal. Via the abovementioned architecture of the present invention, the half-bridge driving unit 43 can work in a zero-voltage switching state constantly. In the present invention, the duty cycle needn't vary with the dimming signal or the load 2. Therefore, the present invention can decrease the switching loss and increase the service lives of electronic elements.

In the present invention, the voltage-adjustment/control circuit 462 may be an integrated circuit, and the load 2 may be a set of lamps, and the half-bridge driving unit 43 may be an asymmetrical half-bridge energy-conversion circuit.

The preferred embodiments described above are only to exemplify the present invention but not to limit the scope of the present invention. Any modification or variation according to the scope of the present invention is to be also included within the scope of the present invention, which is based on the claims stated below.

According to the preceding description, the present invention has improvements over the conventional technologies. Thus, the present invention possesses novelty and non-obviousness and meets the condition for a patent. Therefore, the Inventor files the application for a patent. It will be appreciated if the patent is approved fast.

What is claimed is:

1. A front-stage voltage-adjustment inverter, which receives an input power and converts said input power into a driving power to drive at least one load, and which comprises: a rectifier unit receiving and rectifying said input power; a duty cycle modulation unit generating a cycle signal; a half-bridge driving unit driven by said cycle signal; and a transformer unit driven by said half-bridge driving unit to convert said input power into said driving power, wherein said inverter is coupled to a dimming signal source, and said inverter further comprises:

a front-stage voltage-adjustment unit coupled to between said rectifier unit and said half-bridge driving unit, receiving said input power, determining a voltage-adjustment level according to a dimming signal, and according to said voltage-adjustment level, varying the voltage of said input power, which said half-bridge driving unit conducts to said transformer unit, to adjust the voltage of said driving power, which said transformer unit generates at a secondary side thereof;

wherein a feedback unit is coupled to said secondary side of said transformer unit to generate a feedback signal, and said front-stage voltage-adjustment unit modifies the voltage of said input power to stabilize the voltage of said driving power according to said feedback signal.

2. The front-stage voltage-adjustment inverter according to claim 1, wherein said front-stage voltage-adjustment unit further comprises a buck circuit and a voltage-adjustment/control circuit, and said voltage-adjustment/control circuit receives said dimming signal and a feedback signal and generates a periodic switching signal to control a duty cycle, which switches said buck circuit.

3. The front-stage voltage-adjustment inverter according to claim 2, wherein said voltage-adjustment/control circuit is an integrated circuit.

4. The front-stage voltage-adjustment inverter according to claim 1, wherein said load is a set of lamps.

5. The front-stage voltage-adjustment inverter according to claim 1, wherein a power factor correction unit is arranged in between said front-stage voltage-adjustment unit and said rectifier unit, and said power factor correction unit is used to regulate the current phase of said input power.

6. The front-stage voltage-adjustment inverter according to claim 1, wherein said half-bridge driving unit is an asymmetrical half-bridge energy-conversion circuit.

* * * * *